US007377979B2

(12) United States Patent
Sakayori et al.

(10) Patent No.: US 7,377,979 B2
(45) Date of Patent: May 27, 2008

(54) MATERIAL COATING DEVICE

(75) Inventors: Toshimasa Sakayori, Tokyo (JP); Takashi Nemoto, Tokyo (JP); Kenichi Horie, Tokyo (JP)

(73) Assignee: Three Bond Co., Ltd., Tokyo (JP)

( * ) Notice: Subject to any disclaimer, the term of this patent is extended or adjusted under 35 U.S.C. 154(b) by 0 days.

(21) Appl. No.: 10/500,303

(22) PCT Filed: Jan. 22, 2003

(86) PCT No.: PCT/JP03/00560

§ 371 (c)(1),
(2), (4) Date: Jun. 28, 2004

(87) PCT Pub. No.: WO03/061847

PCT Pub. Date: Jul. 31, 2003

(65) Prior Publication Data

US 2005/0081784 A1 Apr. 21, 2005

(30) Foreign Application Priority Data

Jan. 24, 2002 (JP) ..... 2002-015633
Sep. 20, 2002 (JP) ..... 2002-275430

(51) Int. Cl.
*B05B 3/00* (2006.01)
*B05B 13/02* (2006.01)
*B05B 1/02* (2006.01)
*B05C 5/00* (2006.01)

(52) U.S. Cl. ..... 118/323; 118/305; 239/601

(58) Field of Classification Search ..... 118/305, 118/323, 320, 321, 300, 410, 413; 156/356, 156/578; 239/601, 589; 427/424, 427.3; 422/100, 63
See application file for complete search history.

(56) References Cited

U.S. PATENT DOCUMENTS 4,207,929 A 6/1980 Stoner (Continued)

FOREIGN PATENT DOCUMENTS

DE 4406762 A1 * 9/1995

(Continued)

OTHER PUBLICATIONS

English Translated Abstract (DE 4406762 A1), Sep. 1995.*

(Continued)

*Primary Examiner*—Yewebdar Tadesse
(74) *Attorney, Agent, or Firm*—Westerman, Hattori, Daniels & Adrian, LLP.

(57) ABSTRACT

A material application apparatus 10 comprises a base 11 on which a workpiece W is placed, a syringe 13 that applies a material onto a movement track L, a movement structure 14 that moves the syringe 13 in three orthogonal axes directions, a rotation mechanism 15 that rotates the syringe 13 around the axis line of the syringe 13, and a control unit 17 that controls the movement structure 14 and the rotation mechanism 15 in accordance with a configuration of the track L. The syringe 13 includes a nozzle 19 provided to the front-end side of a main body 18 that contains a sealing agent or a material of resin used as an adhesive agent or the like. The discharge port 21 of the nozzle 19 is formed into a generally acute-angled triangle configuration to discharge the material so that a bead B having a sectional configuration in which the height is larger than 0.9 compared to the width of 1 can be formed. Also, the nozzle is adapted so as to be rotated in the periphery direction thereof by a motor M.

1 Claim, 11 Drawing Sheets

U.S. PATENT DOCUMENTS

| | | | | |
|---|---|---|---|---|
| 4,207,931 | A | 6/1980 | Tomson et al. | |
| 4,564,410 | A * | 1/1986 | Clitheros et al. | 156/356 |
| 4,844,004 | A * | 7/1989 | Hadzimihalis et al. | 118/315 |
| 4,964,362 | A * | 10/1990 | Dominguez | 118/315 |
| 5,906,682 | A * | 5/1999 | Bouras et al. | 118/712 |
| 6,139,639 | A * | 10/2000 | Kitamura et al. | 118/680 |
| 2005/0271806 | A1 * | 12/2005 | Ganzer et al. | 427/207.1 |

FOREIGN PATENT DOCUMENTS

| | | | |
|---|---|---|---|
| JP | 51-58167 | A | 5/1976 |
| JP | 54-67762 | | 10/1977 |
| JP | 54-67762 | | 5/1979 |
| JP | 60-171585 | U | 11/1985 |
| JP | 63-160974 | A | 7/1988 |
| JP | 4-260466 | | 9/1992 |
| JP | 9-52064 | A | 2/1997 |
| JP | 09-092134 | A | 4/1997 |
| JP | 10-15456 | | 1/1998 |
| JP | 10-57867 | | 3/1998 |
| JP | 10-328605 | A | 12/1998 |
| JP | 2000-237661 | A | 9/2000 |
| JP | 2001-135927 | | 5/2001 |
| JP | 2001-135927 | A | 5/2001 |
| JP | 2001-182836 | A | 7/2001 |
| JP | 2002-184303 | A | 6/2002 |

OTHER PUBLICATIONS

Japanese Patent Application No. 2002-015633 mailed Aug. 9, 2006.

Preliminary Examination, Search and Substantive Examiner Report dated Feb. 23, 2007 issued in corresponding Malaysian Application No. PI 20030022.

Office Action dated Sep. 4, 2007, issued in corresponding Japanese Application No. 2002-275430.

* cited by examiner

MATERIAL COATING DEVICE

TECHNICAL FIELD

The present invention relates to a material application apparatus, and in particular, to a material application apparatus capable of reliably forming a bead, which allows a desired deformation with a low pressure force, on a surface to be applied of a workpiece; and, when changing the application direction using a nozzle with a non-circular discharge port, capable of rotating the nozzle at a high speed in the periphery direction thereof.

BACKGROUND ART

As for a material application apparatus for applying a resin material to the surface of a workpiece, conventionally, for example, a material application apparatus is known, which, to the peripheral area of a main body case of a hard disk as the surface, applies a sealing agent onto a track generally along the periphery of the main body case. The material application apparatus comprises a syringe equipped with a nozzle capable of discharging the sealing agent, and a movement means such as a robot which moves the syringe along a predetermined movement track, which has been taught beforehand. The nozzle is formed with a discharge port having a generally circular opening at the front-end thereof, moves along the movement track while discharging the sealing agent from the discharge port, and thereby the sealing agent is applied to the main body case; and as a result, a generally dome-like shaped bead having a flattened sectional configuration is formed. The main body case, on which the bead of the shape is formed, is overlapped with a cover, and is secured with screws at several points from the outside of the cover to integrate the cover with the main body case. In this case, the bead is pressed from the top by the cover, and the bead is interposed between the case main body and the cover accompanying a deformation due to the pressure.

However, in the material application apparatus, since a generally dome-like shaped bead having a flattened sectional configuration is formed, amount of deformation at the top side of the bead is small resulting in such problem that, in a state that a cover is attached to the case main body, the sealing performance there between gets easily decreased. Particularly, in the area of the cover away from the screwed points or the like, the problem arises more seriously since the pressure force to the bead becomes lower than that of the areas of the cover near the screwed point. On the other hand, when the screw force to the cover is increased in order to increase the pressure force to the bead in the areas of the cover away from the screwed points, another kind of problem arises such that an excess pressure force is given to the bead near the screwed points resulting in easy cut off of the bead in the area.

Accordingly, the inventor has discovered that, in the above-described case, it is preferred to adopt a sectional configuration of the bead that allows an effective deformation with a low-pressure force. That is to say, a sectional configuration of an acute-angled triangle; i.e., a relatively slim sectional configuration in which, for example, the height is larger than 0.9 compared to the width of 1, or the like is preferred.

In Japanese patent publication (Kokai) 1992-260466, an adhesive agent application apparatus, having a triangle-like opening viewed from the front side thereof formed in the peripheral side of the nozzle as a discharge port for the adhesive agent, and being capable of forming a bead having a triangle-like sectional configuration, is disclosed.

However, in the adhesive agent application apparatus, according to experiments carried out by the inventors, a fact was found that the topside of the bead tends to be formed flat and a bead having a sectional configuration that solves the problem can not formed reliably. The reason of this is why, since the discharge port is formed in the peripheral side of the nozzle, the flow direction of the adhesive agent and the discharge direction thereof cross each other at right angles in the nozzle; due to this, it is understandable that a large discharge resistance is given to the adhesive agent at the top end side of the discharge port when the adhesive agent is discharged therefrom. Further, in case that the bead is applied in a manner of one stroke, it is necessary that the start and endpoints of the application coincide with each other accurately. However, with the nozzle having the above-described configuration, it is extremely difficult to control to achieve the above. Furthermore, for example, in case that the object to be applied is small like a hard disk cover or the like, in many cases, obstacles (protrusion or rib) may exist adjacent to a flange to be formed with the bead, or the size itself of the flange is small and narrow. In such circumstances, there may be a case that the bead cannot be formed using the nozzle having the structure as disclosed in the Japanese patent publication 1992-260466.

DISCLOSURE OF THE INVENTION

The present invention has been proposed in view of the problems and the findings of the inventor. Accordingly, an object of the invention is to provide a material application apparatus capable of reliably forming a bead that allows a desired deformation by means of a low-pressure force on the surface of a workpiece.

Another object of the invention is to provide a material application apparatus capable of controlling the nozzle to rotate in the periphery direction thereof even when a movement track for the discharge port is not in a straight line but in a bent direction to ensure a bead having a specific sectional configuration anytime.

Still another object of the invention is to provide a material application apparatus capable of applying material along a preset track with a high precision without causing any positional displacement of the rotational axis even when rotating the nozzle in the periphery direction thereof.

In order to achieve the objects, the invention adopts a constitution such that a material application apparatus that applies-a material from a discharge port of the nozzle along a predetermined movement track on the surface while performing relative displacement of a surface of a workpiece disposed on a base and a nozzle with respect to each other, wherein the discharge port is formed into a non-circular configuration and discharges the material so as to form a bead having a sectional configuration in which the height is larger than 0.9 compared to the width of 1. By adopting the constitution, flow direction of the material in the nozzle and the discharge direction thereof substantially coincide with each other, and it is possible to discharge the material onto the surface while generally maintaining the configuration of the discharge port, and a bead allowing a desired deformation with a low pressure force can be formed reliably on the surface. Herein, it is preferable that the bead have such sectional configuration that the height is larger than the width.

Also, the invention adopts such constitution that a material application apparatus comprises an application means for applying a material to a surface of a workpiece disposed on a base, and a movement means that makes the application means perform relative displacement along a predetermined movement track on the surface so as to apply the material into a bead configuration, wherein:

the application means includes a syringe and a nozzle connected to the syringe and provided with a discharge port formed into a non-circular configuration;

the nozzle is adapted to be rotatable in the periphery direction thereof in a state that the syringe is not rotated in the periphery direction thereof. By adopting the constitution, when the movement track is set in two-dimensional directions, i.e., the movement track is set as a closed loop or in a direction along a curved line, it is possible to form a bead having a stable sectional configuration by rotating the nozzle in the periphery direction thereof, while keeping the discharge port in a specific positional relationship with respect to the surface. Furthermore, since rotation of the syringe in the periphery direction thereof does not accompany, it is possible to be free from a restriction on the capacity of the syringe.

In the invention, it is preferred to adopt such constitution that the discharge port is formed into a profile or opening configuration in which a first end portion positioned at the front end side in the direction of the movement along the movement track is wider than a second end portion positioned at the rear end side in the width in the direction crossing the movement track. By adopting the constitution, a portion of the bead corresponding to the first end portion of which width in the direction crossing the movement track is wider comes into contact with the surface prior to the portion of the bead corresponding to the second end portion, and a bead having a sectional configuration in which the top end is smaller than the bottom end in width can be formed reliably. Herein, it is possible to adopt such constitution that the nozzle is controlled to rotate so that the first end portion precedes the second end portion generally throughout the movement track. With this arrangement, it is possible to handle a track having curved-portions, such as a closed loop-like track without difficulty.

The invention adopts such constitution that the nozzle is adapted to be rotatable in the periphery direction thereof by a motor provided with an output shaft positioned generally parallel to the nozzle, and by a drive force transmission member between the output shaft and the nozzle. As for the drive force transmission member, a belt and a gear mechanism for interconnecting the output shaft and the nozzle to each other are exemplified. By adopting the constitution, since a relatively light weight member, which is rotated in the periphery direction thereof, is applicable for the nozzle, a desired performance can be obtained even when a small size motor is adopted. And further, it is possible that the distance between a drive source and the discharge port can be made closer to each other to maintain the rotational center axis of the nozzle at a fixed position. As a result, it is possible to apply the material discharged from the discharge port precisely along a preset movement track. Furthermore, the moment of inertia accompanying the rotation of the nozzle also can be made smaller and, in this point also, it is possible to reduce the load to the motor.

It is preferred that the discharge port of the nozzle is formed into an acute-angled triangle configuration having abase edge portion and a pair of side edge portions constituting two equilaterals longer than the base edge portion. In this case, it is adapted so that the nozzle moves with the base edge portion as the first edge portion and the intersection point of the side edge portions as the second edge portion.

Further, it is preferred that the material is imparted with an appropriate degree of viscosity and thixotropic characteristic to maintain the application configuration. For example, when forming a bead of which width of the first edge portion is approximately 1-1.5 mm, it is preferred to adopt simultaneously such constitution that degree of viscosity is set to 10000 cP-400000 cP; while, thixo-index is set to 4-10. In this case, when the degree of viscosity is below 10000 cP, the configuration at application cannot be maintained. While, when the degree of viscosity exceeds 400000 cP, the application gets harder, or stringiness of the applied material is caused and a horn-like protrusion may be formed easily. When the thixo-index is below 4, in this case also, the configuration cannot be maintained. While, when the thixo-index exceeds 10, stringiness of the applied material is caused and a horn-like protrusion may be formed easily. Further, when the applied bead is formed into one stroke-like configuration (into a ring-like configuration), since the start and end points of the application are overlapped with each other, it is preferred to adapt the characteristics of the material so that the material fuses together at the overlapped area.

Furthermore, in order to maintain the configuration at application, it is preferred to adapt the material after taking into consideration the characteristics such as, for example, the gravity thereof, the nature of the material (in the case of a resin which reacts to moisture and heat, temperature and humidity at application), and the thickness and length of the bead to be formed, in addition to the degree of viscosity and the thixo-index.

Still further, it is preferred to adopt such constitution that the relative displacement speed between the surface and the nozzle and the discharge speed of the material from the discharge port are adapted so as to substantially coincide with each other. With this arrangement, it is possible to form a bead having a sectional configuration, in which the height is larger than the width, further reliably.

It is preferred that the space distance between the discharge port and the surface is set to approximately 1.5-3 times as the height of the bead. When the space distance is under 1.5 times as the height of the bead, the vertex of the bead having the triangle sectional configuration or the like tends to be deformed; while, when the space distance exceeds 3 times as the height of the bead, there may be a case that the bead undulates unevenly or deviates from the application position.

In this description, the term "section" applied to the bead means, if not otherwise specified, the vertical section in the direction approximately crossing the extending direction of the bead. Further, the terms "width" and "height" applied to the bead mean the dimensions in the right and left direction and in the vertical direction respectively in the section of the bead shown in FIG. 4.

Furthermore, the term "thixo-index" means a proportion between the measured values obtained by measuring the degree of viscosity of the material while changing the number of revolutions on a viscometer, in particular, a proportion of viscosity obtained based on the measurement according to JISK7117. That is to say, a proportion between the degree of viscosity at a speed of 2 rotations per minute and the degree of viscosity at a speed of 20 revolutions per minute measured using a BHtype revolution viscometer (rotor No.7).

BEST MODE FOR CARRYING OUT THE INVENTION

Now, embodiments of the invention will be described below with reference to the attached drawings.

First Embodiment

Figure 1:
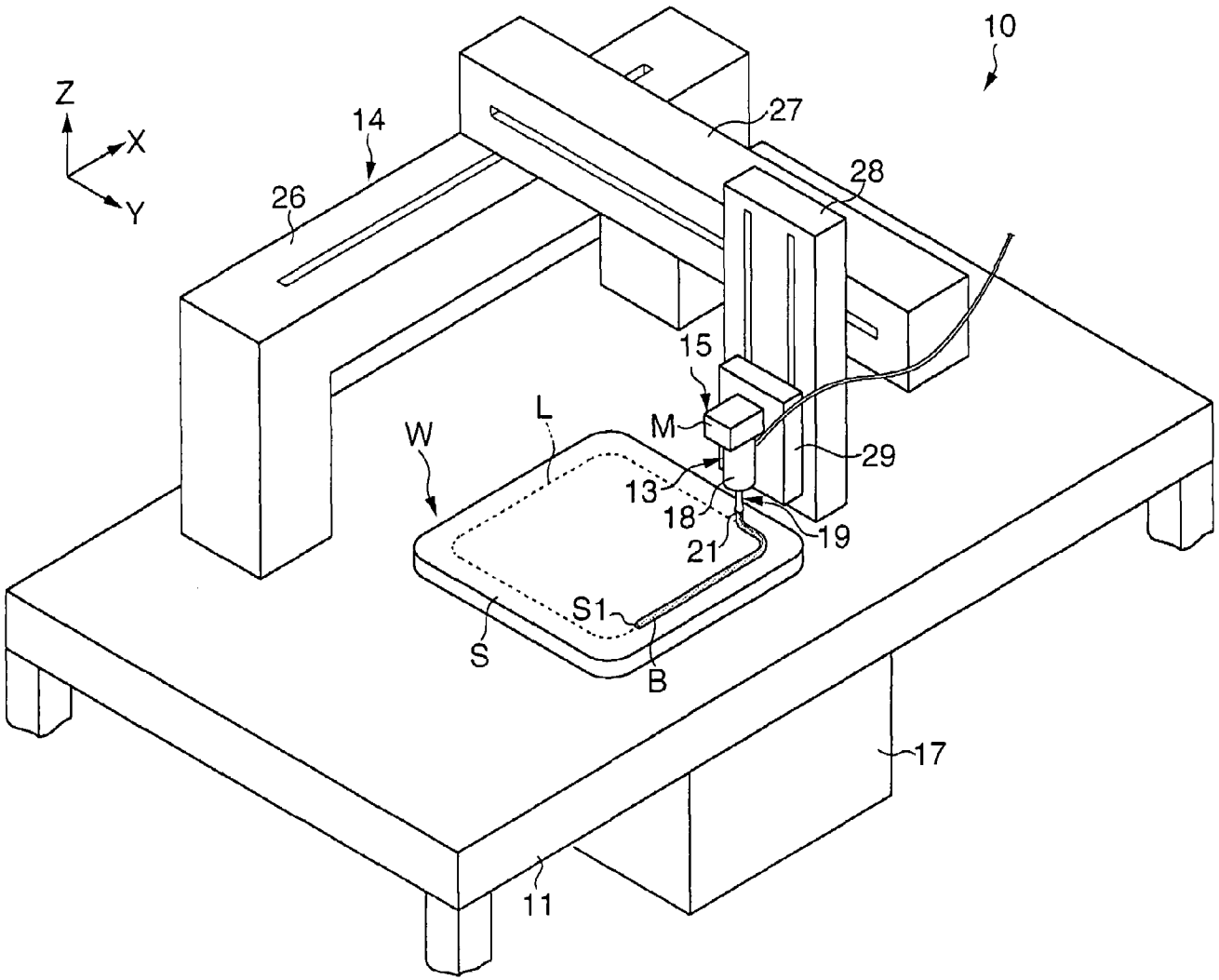
FIG. 1 is a perspective view schematically showing a material application apparatus according to a first embodiment of the invention.
Figure 2:
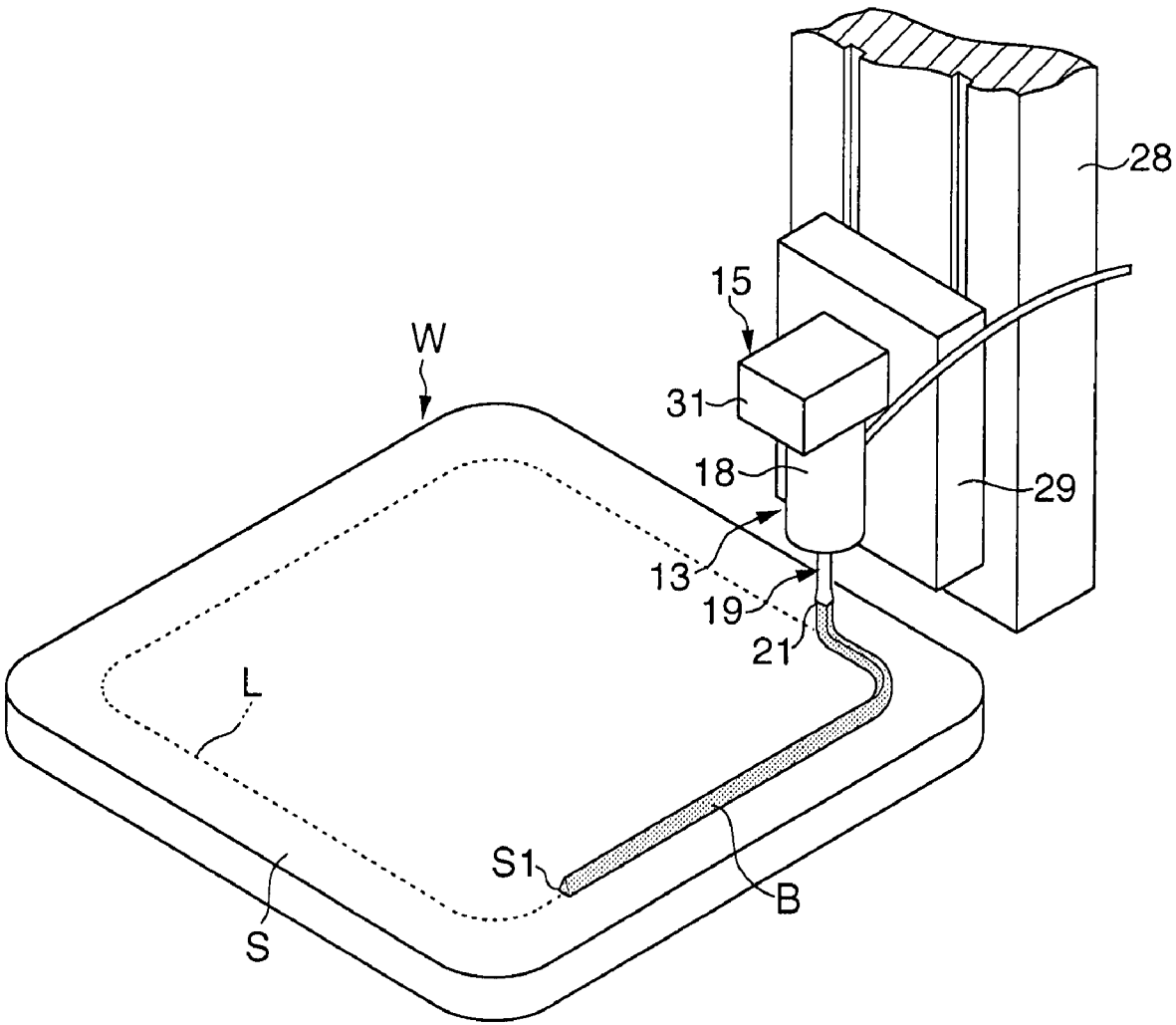
FIG. 2 is an enlarged view showing principal parts of FIG. 1.

FIG. 1 is a perspective view schematically showing a material application apparatus according to a first embodiment of the invention; FIG. 2 is an enlarged view showing principal parts of FIG. 1. In these drawings, a material application apparatus 10 is an apparatus that forms a bead B on a track L by applying a material such as a sealing agent along a desired movement track L on a surface S to be applied therewith of a workpiece W. That is to say, the material application apparatus 10 comprises a base 11 on which the workpiece W is placed, a syringe 13 that applies the material onto the track L, a movement structure 14 that moves the syringe 13 in the directions of three orthogonal axes (X-axis, Y-axis and Z-axis in FIG. 1), a rotation mechanism 15 that rotates the syringe 13 around the axis line of the syringe 13, and a control unit 17 that controls a movement structure 14 and a rotation mechanism 15 in accordance with the track L. The track L in the embodiment is set as a closed loop forming generally a square in configuration viewed from the top.

The syringe 13 comprises a main body 18 that stores a material of a resin used as a sealing agent, an adhesive agent or the like, and a nozzle 19 provided to the front-end side of the main body 18. It is adapted so that the material is discharged from a discharge port 21 formed at the bottom end of the nozzle 19 by pressurizing the material within the main body 18 by means of a pressurizing unit (not shown). Herein, as for the material, one prepared using epoxy resin, silicon resin, urethane resin, acrylate resin, rubber or modified materials of them, wherein the degree of viscosity thereof is set to 10000 cP-400000 cP and the thixo-index thereof is set to 4-10, is used.

Figure 3:
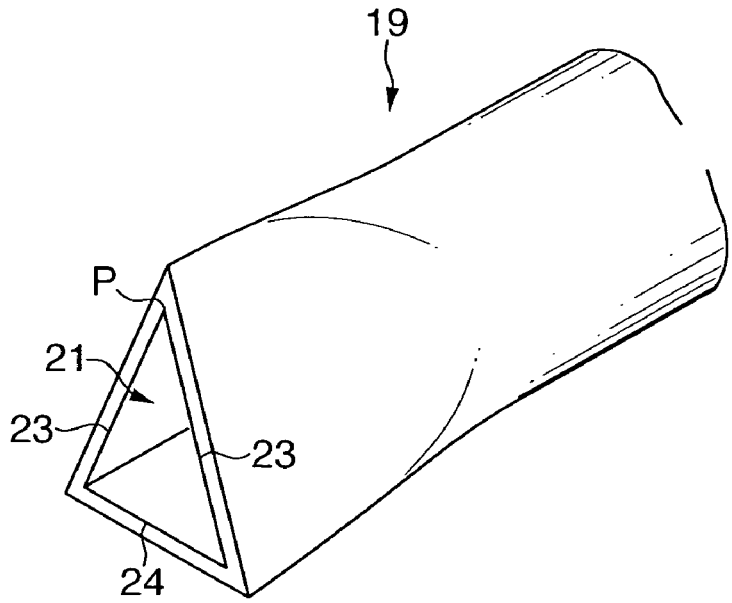
FIG. 3 is an enlarged perspective view of the front end side of a nozzle.
Figure 4:
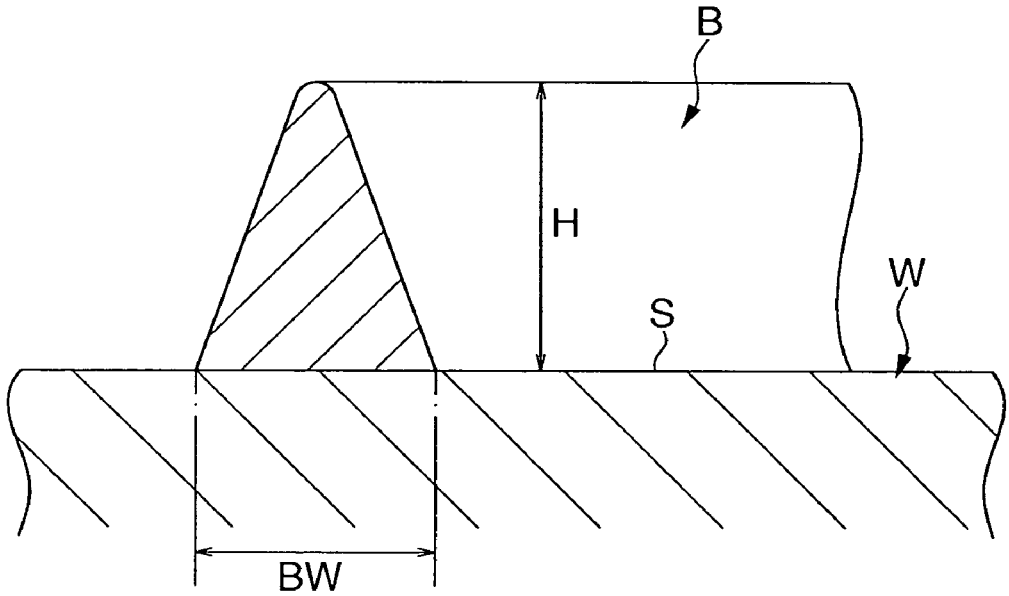
FIG. 4 is a vertical sectional view of a bead.

As shown partially in FIG. 3, the nozzle 19 is formed into a configuration equipped with a discharge port 21 whose front-end portion positioned at the left side in FIG. 3 is formed into a generally triangle pole-like configuration and opens in a configuration of a generally acute-angled triangle. That is to say, the discharge port 21 is formed into a profile, or an opening configuration that includes a vertex, or a top portion P at the acute angle side, which is positioned at the top side in FIG. 3; a pair of side edges 23,23, which extend slantwise downwardly from the vertex P in FIG. 3; and a base edge portion 24, which is connected to the side edges 23,23 at the bottom ends thereof in FIG. 3. Owing to the configuration of the discharge port 21, it is possible to obtain the bead B that is formed out of the material discharged from the discharge port 21, the bead B having, as shown in FIG. 4, an acute-angled triangle sectional configuration generally corresponding to the configuration of the discharge port 21; in other words, the bead having a relatively slim sectional configuration in which height H is larger than width BW.

That is to say, according to the embodiment, the width of the base edge portion 24 of the discharge port 21 is set to about 1.3 mm; while, the shortest distance between the base edge portion 24 and the vertex P, i.e., the height of the discharge port 21 is set to about 1.6 mm. The bead B, which is formed using the nozzle 19 having the above-described size, at a temperature during application set to 25° C., is resulted in such dimensions that the width BW is about 1.3 mm; and the height H is about 1.4 mm.

As shown in FIG. 1, the movement structure 14 comprises an X-axis rail structure 26 having a generally gate-like configuration viewed from the lateral side, which extends in the direction of the X-axis in FIG. 1; a Y-axis rail structure 27 capable of moving along the X-axis rail structure 26, which extends in the direction of the Y-axis in FIG. 1; a Z-axis rail structure 28 capable of moving along the Y-axis rail structure 27, which extends in the direction of the Z-axis in FIG. 1; and a syringe holder 29 that holds the syringe 13, and that is adopted to move in the vertical direction with respect to the Z-axis rail structure 28. Herein, although omitted in the drawings, the respective structures 26-28 and the syringe holder 29 comprise a drive mechanism such-as a motor, a feed screw shaft, a cylinder for operating the relevant mechanism. These motor, cylinder or the like are adopted so that the control unit 17 controls them. Further, the movement structure 14 is not limited to the above-described structure. When the syringe 13 can be moved within a predetermined space, another mechanism maybe adopted. For example, although the Y-axis rail structure 28 is supported at one side in the example shown in the drawings, a structure in which a pair of the X-axis rail structures 26 is disposed to support the Y-axis rail structure 28 at both sides; or, a multi-joint arm or the like are exemplified.

The rotation mechanism 15 comprises a motor M that is fixedly disposed with respect to the syringe holder 29, and it is adapted so that the control unit 17 controls the rotation of the motor M.

Figure 5:
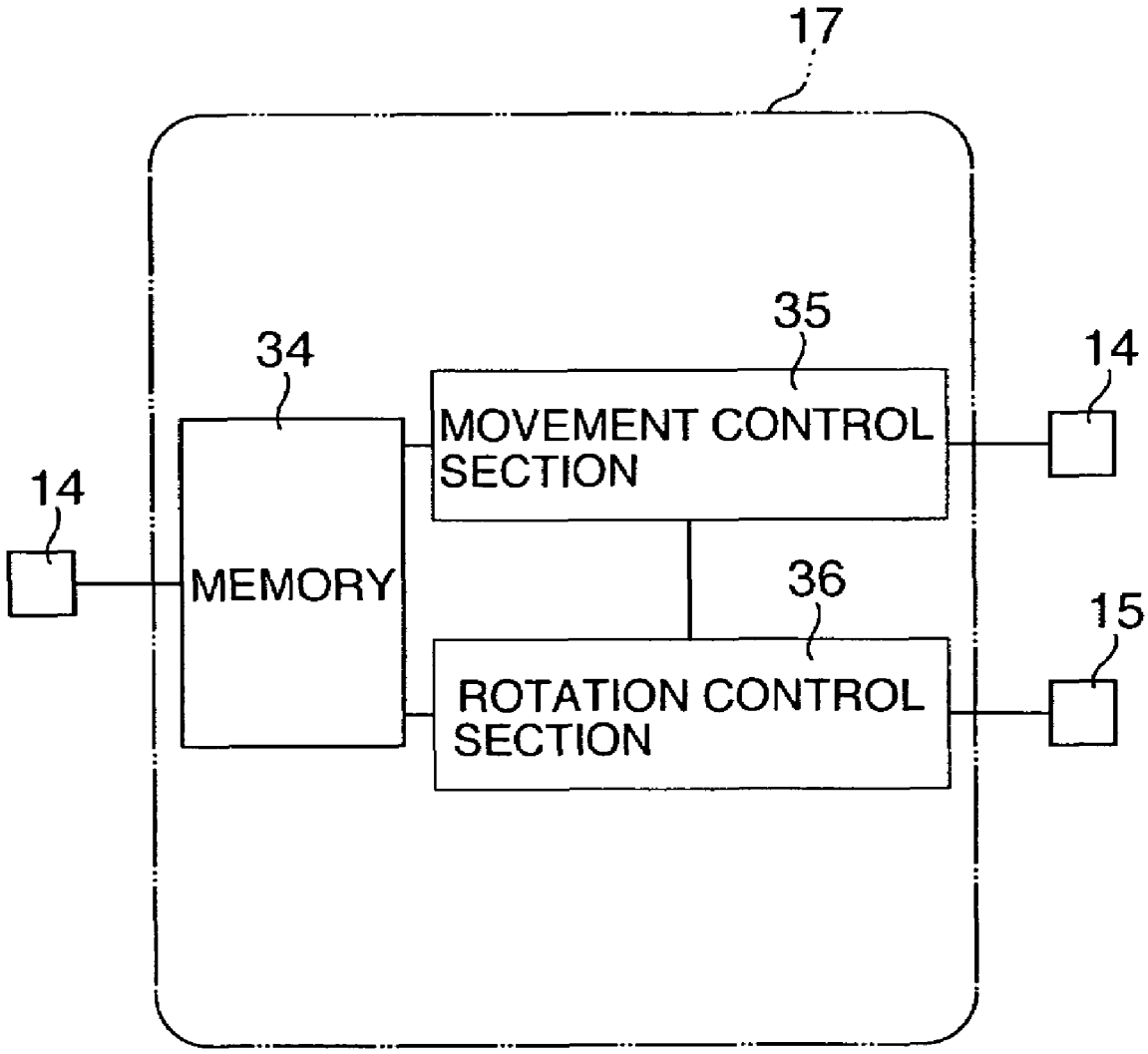
FIG. 5 is a block diagram illustrating the respective sections constituting a control unit.

As shown in FIG. 5, the control unit 17 is provided with a memory 34 that memorizes predetermined data, a movement control section 35 and a rotation control section 36 that control the movement structure 14 and the rotation mechanism 15 based on the data of the memory 34.

The memory 34 is adapted to memorize the track L, obtained by moving the syringe 13 in manual mode with the front-end side of the nozzle 19 (refer to FIG. 1) being faced the workpiece W, as the teaching data.

Figure 6:
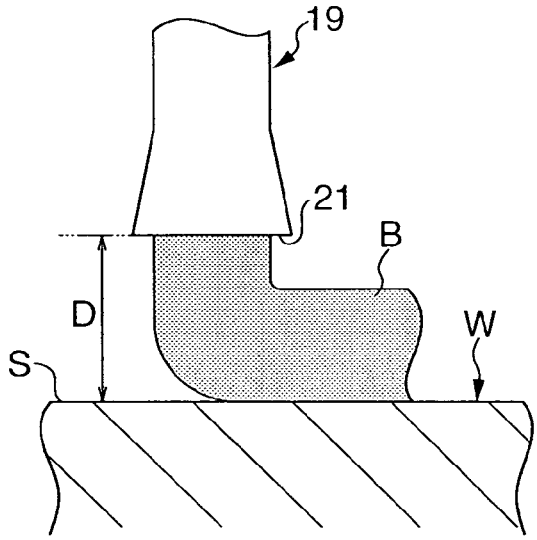
FIG. 6 is an enlarged side view illustrating a space distance between the front end of the nozzle and the surface of a workpiece.
Figure 7:
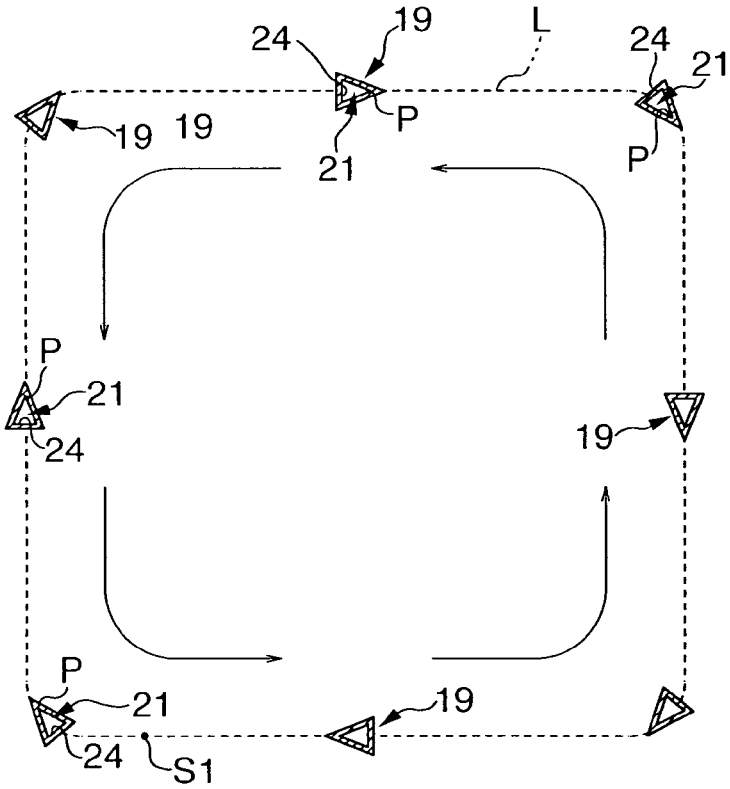
FIG. 7 is a view schematically illustrating rotation control of the nozzle.

The movement control section 35 controls the movement structure 14 so that, after moving the discharge port 21 of the nozzle 19 above the start point S1 of the track L, the nozzle 19 is moved from the start point S1 along the track L while keeping the material in a state being discharged from the discharge port 21. Herein as shown in FIGS. 6 and 7, the nozzle 19 is adapted to move over the track L along the same in the counterclockwise direction, while fixing the space distance D between the discharge port 21 and the surface S to a state of a generally specific distance. The space distance D is set to a distance around 1.5-3 times of the height H of the bead B (refer to FIG. 4), H being the shortest distance between the vertex P and the base edge portion 24 of the discharge port 21. The movement speed of the nozzle 19 along the track L is set to a speed that generally coincides with the discharge speed of the material from the discharge port 21. According to the embodiment, the speed is set to a speed of 50 mm/s or less.

The rotation control section 36 is for controlling the rotation of the nozzle 19 when the nozzle 19 moves along the track L. As shown in FIG. 7, the rotation control section 36 controls the rotation of the nozzle 19 so that, generally throughout the track L, the base edge portion 24 is positioned at the front end side in the direction of movement over the track L; while, the vertex P is positioned at the rear-end side; and so that the base edge portion 24 crosses the track L approximately perpendicular thereto. Owing to this arrangement, the base edge portion 24 constitutes a first edge positioned at the front end side in the direction of movement on the track L; while the vertex P constitutes a second edge positioned at the rear-end side in the direction of movement on the track L; and the base edge portion 24 of which width in the direction crossing the track L is wider than that of the vertex P moves over the track L preceding the vertex P.

Next, referring to FIG. 1 and the like, the material application operation in the material application apparatus 10 will be described below.

In a state that the track L is memorized in the control unit 17 as the teaching data, a workpiece W for which the teaching data is used is placed at a predetermined position of the base 11. When a switch not shown in the drawings is turned ON, the nozzle 19 moves to the start point S1 of the track L. And when the discharge port 21 is positioned above the start point S1, the material begins to be discharged from the discharge port 21. Keeping the state of discharging, the front-end of the nozzle 19 goes around over the track L from the start point S1 in the counterclockwise direction based on the teaching data. Herein, as shown in FIG. 7, the rotation of the nozzle 19 is controlled so that the base edge portion 24 of the discharge port 21 always precedes the vertex P. Thus, as shown in FIG. 4, the material applied onto the surface S of the workpiece W forms the bead B, having a sectional configuration of a generally acute-angled triangle configuration corresponding to the discharge port 21, on the track L. Herein, a part of the bead B corresponding to the base edge portion 24 comes into contact with the surface S; while a portion of the bead B corresponding to the vertex P is positioned at the top side thereof.

Consequently, according to the embodiment, since the material is discharged in the same direction as the flow direction of the material within the nozzle 19, and since the configuration of the discharge port 21 of the nozzle 19 is formed into a generally acute-angled triangle configuration, such effect is obtained that the bead B allowing a large deformation amount with a smaller pressure force can be formed reliably.

Second Embodiment

FIGS. 8-11 show a second embodiment of the invention. The second embodiment is characterized in that the nozzle is adapted so as to rotate in the periphery direction thereof without rotating the syringe in the periphery direction thereof. A material application apparatus 100 according to the second embodiment comprises a base 111, an application means 114 including a syringe 112 and a nozzle 113 that is capable of moving along a preset movement track L (refer to FIG. 11) with respect to the surface S of a workpiece W disposed via a table T on the base 111, a rotation mechanism 115 that rotates the nozzle 113 in the periphery direction thereof, and a movement means 116 that moves the application means 114 in the directions of three orthogonal axes.

Figure 9:
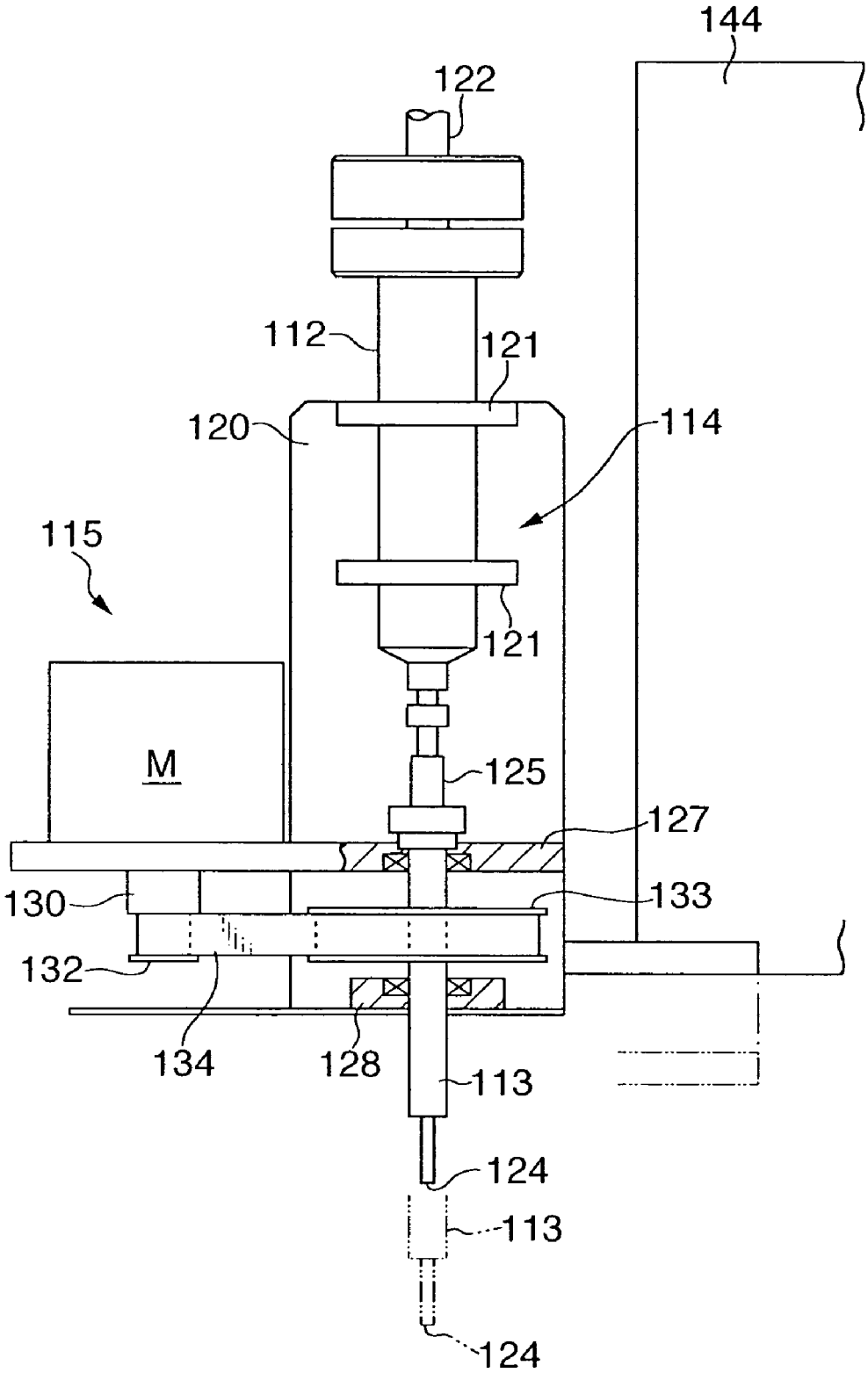
FIG. 9 is an enlarged view of principal parts of FIG. 8.
Figure 10:
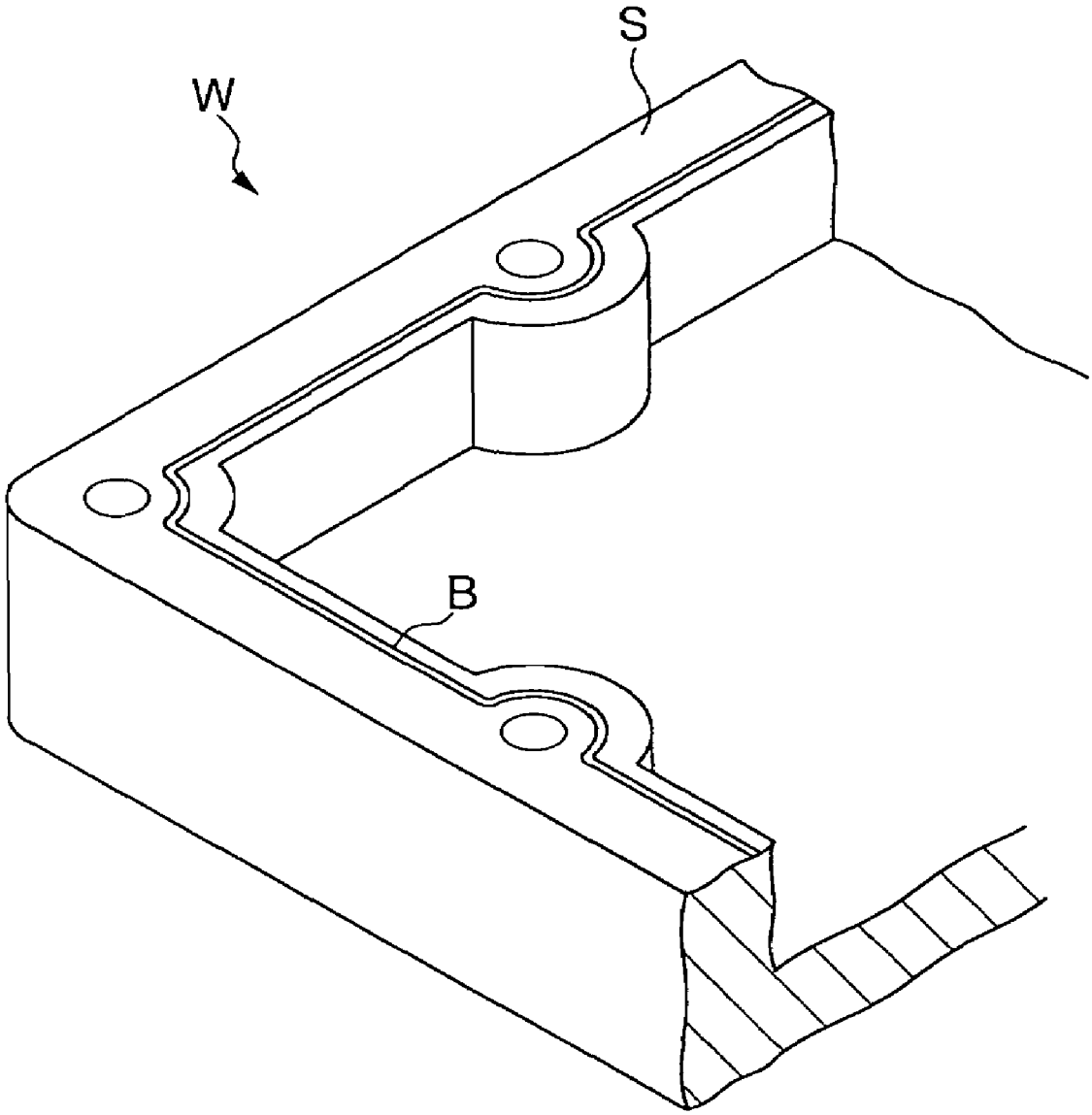
FIG. 10 is a perspective view schematically showing a state, in which a material is applied to a workpiece.

As shown in FIG. 9, the syringe 112 is fixed by brackets 121,121 at two points in the axial direction on the upper portion of a holder 120 oriented vertically. The syringe 112 is adapted such that a material of resin, which is used as a sealing agent or an adhesive agent or the like, is charged via a supply pipe 122 and stored therein; and the material stored in the syringe 112 can be discharged from a discharge port 124 positioned at the bottom end of the nozzle 113 by the pressurizing force by means of a pressurizing unit which is not shown in the drawings. Herein, the material, the degree of viscosity and the thixo-index are the same as those of the first embodiment.

The nozzle 113 is adapted so that the upper end thereof can rotate in the periphery direction thereof via a connecting tube 125 disposed at the bottom side of the syringe 112. The nozzle 113 is supported rotatably at upper and lower two points via an upper bearing plate 127 and a lower bearing plate 128 which are secured at upper and lower two points in the lower portion of the holder 120. Supported on the upper face of the upper bearing plate 127 is a motor M capable of rotating in the forward and reverse directions. An output shaft 130 of the motor M extends vertically through the upper bearing plate 127 in substantially parallel with respect to the nozzle 113. Fixed to the output shaft 130 is a pulley 132 while, fixed to the periphery of the nozzle 113 is a large diameter pulley 133, and attached around between these pulleys 132,133 is a belt 134 as a drive force transmission member. Accordingly, by driving the motor M, the nozzle 113 can be rotated in the periphery direction thereof without rotating the syringe 112 in the periphery direction thereof. Thus, the rotation mechanism 115 of the nozzle 113 comprises the motor M, the pulleys 132,133 and the belt 134. The discharge port 124 of the nozzle 113 is the same as that of the first embodiment.

Figure 8:
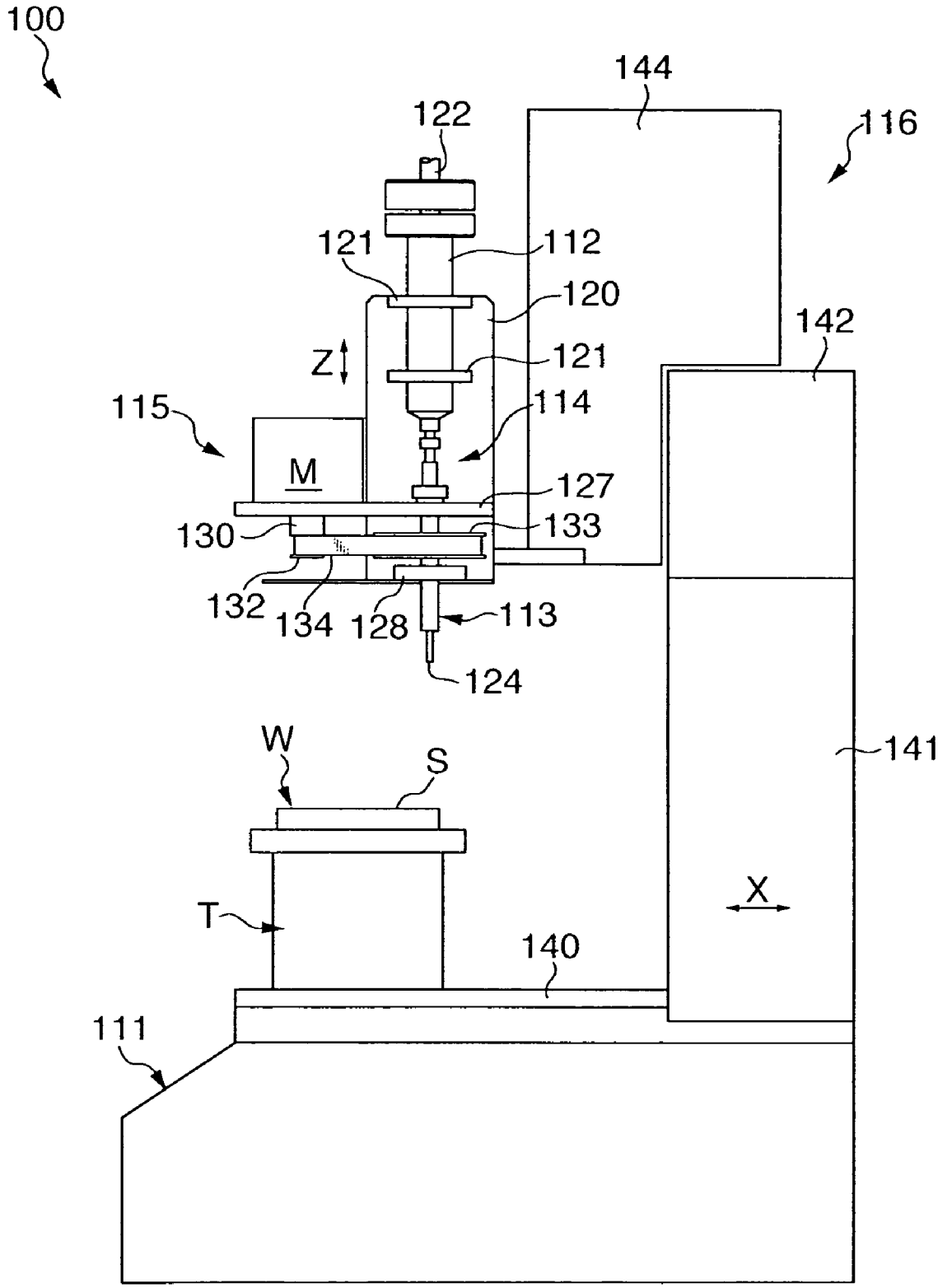
FIG. 8 is a perspective view schematically showing a material application apparatus according to a second embodiment of the invention.

As shown in FIG. 8, the movement means 116 comprises a support 141 adapted so as to be movable in the X-axis direction (right and left direction) in FIG. 8 along a rail 140 on the base 111, a slider 144, supported movably in the Y-axis direction (perpendicular direction to the drawing) along the rail 142 disposed to the upper portion of the support 141 in a posture of one-sided support, and the holder 120 provided to the slider 144 movably in the vertical direction to hold the application means 114. The support 141, the slider 144 and the holder 120 according to the second embodiment are controlled in a predetermined manner respectively by means of a drive mechanism such as a motor, a feed screw shaft or a cylinder, and a control unit that controls the drive mechanism entirely (not shown). The movement means 115 is not limited to the above-described constitution. As long as the syringe 112 and the nozzle 113 connected thereto can be made to perform relative displacement with respect to the surface S of the workpiece W, another constitution may be adopted. According to the second embodiment, although the syringe 112 and the nozzle 113 are constituted movable in three orthogonal axes directions, the workpiece W may be alternatively adapted movable in three orthogonal axes directions.

In a state that the space distance between the discharge port 124 and the surface S is set at a generally fixed level, the nozzle 113 moves over a preset track. In this case, the space distance, the height H of the bead B and the movement speed of the nozzle 113 along the movement track L are the same as those of the first embodiment.

When the nozzle moves along-the movement track L, the rotation of the nozzle 113 is controlled so that the base edge portion 136 is positioned at the front edge side in the direction of movement over the movement track L, that the vertex P is positioned at the rear-end side thereof and that the base edge portion 136 crosses the track generally perpendicular thereto in a plane. Owing to this arrangement, the base edge portion 136 constitutes a first edge portion, which is positioned at the front end side in the direction of movement over the track; the vertex P constitutes a second end portion, which is positioned at the rear end side in the direction of movement over the track; and the base edge portion 136 of which width in the direction crossing the track is wider than that of the vertex P moves along the movement track preceding the vertex P.

Although omitted in the drawings, according to the second embodiment, a positional fine adjustment mechanism for the discharge port 124 is disposed adjacent to the application means 114. Owing to this positional fine adjustment mechanism, it is possible to perform zero-point adjustment when carrying out initial setting or the like before beginning application, and even when an error is generated, it is possible to carry out correction operation easily.

Next, the material application operation in the material application apparatus 100 according to the second embodiment will be described below.

Figure 11:
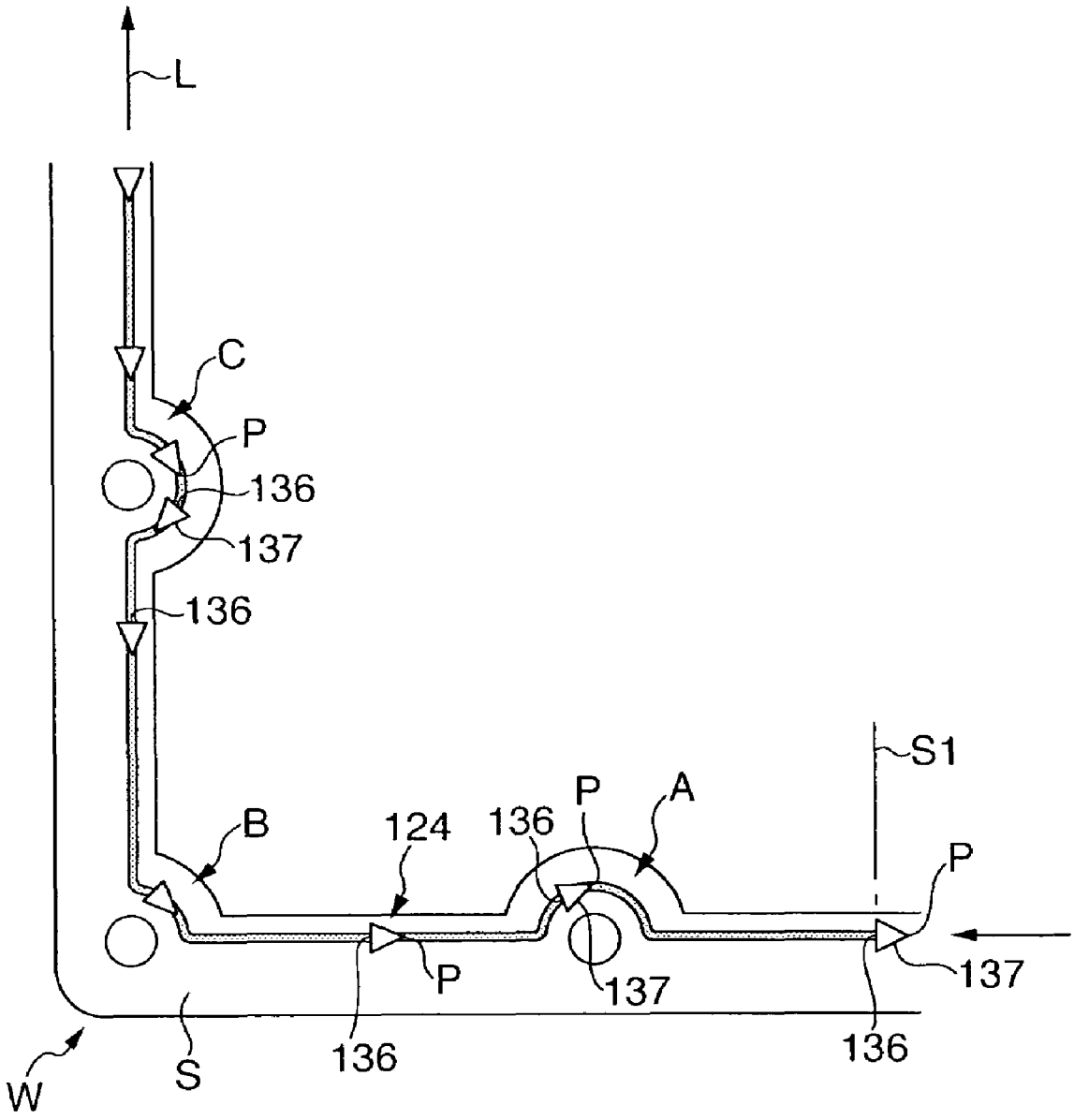
FIG. 11 is a plan view showing the position of the discharge port on the nozzle when applying the material.

In a state that a workpiece W is positioned as designed on the table T, the nozzle 113 is made to perform a teaching operation to read the movement track previously as the data in the control unit, which is not shown in the drawings. When a switch, which is not shown in the drawings, is turned ON, as shown in FIG. 11, the nozzle 113, i.e., the discharge port 124 moves toward the start point S1, and when the discharge port 124 has been positioned at the start point S1, the discharge port 124 begins to discharge the material, and while continuing the discharge, the discharge port 124 moves along the predetermined movement track from the start point S1 based on the teaching data. In this case, even when the movement track is formed into a curved line configuration as in the areas indicated with A, B and C in FIG. 11, the rotation of the nozzle 113 is controlled so that the base edge portion 136 of the discharge port 124 always precedes the vertex P and crosses the movement track. Thus, the material applied on the surface S of the workpiece W forms a bead B having a sectional configuration like a generally acute-angled triangle corresponding to the discharge port 124. Herein, a portion of the bead B corresponding to the base edge portion 136 comes into contact with the surface S, and a portion of the bead B corresponding to the vertex P is positioned at the top side thereof.

Consequently, according to the second embodiment as described above, since such constitution that the nozzle 113 only is rotated without rotating the syringe 112 in the periphery direction thereof is adopted, it is possible to obtain a high speed rotation resulting in an increased material application efficiency.

As described above, although the best constitution, method and the like to exploit the invention have been disclosed in the foregoing descriptions, the invention is not limited thereto.

That is to say, although the invention has been illustrated and described particularly as to mainly specific embodiments, it is possible for those skilled in the art, if necessary, to apply a variety of modifications on the configuration, position, disposition or the like of the embodiments without departing from the scope of the sprit and the object of the invention. For example, the embodiments adopt such constitution that the motor M as a drive source rotates the nozzles 19 and 113. However, in the case where the application movement track has a gently curved-line configuration, which does not change drastically in two dimensional directions, it may be arranged such that a protrusion is provided on the axis of the nozzle and a rod of the cylinder is connected therewith; and the nozzle is rotated by the forward/reverse movement of the rod.

Figure 12:
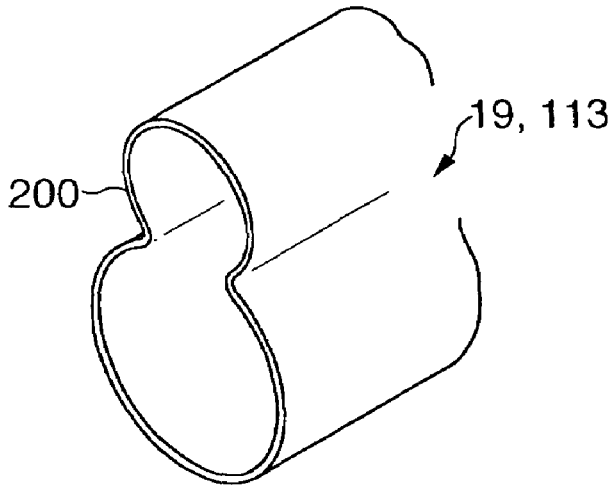
FIG. 12(A) is an enlarged perspective view of the front-end side of a nozzle according to a modification of the embodiment.
FIG. 12(B) is a vertical sectional view of a bead, which is formed when a nozzle in FIG. 12(A) is adopted.
Figure 12:
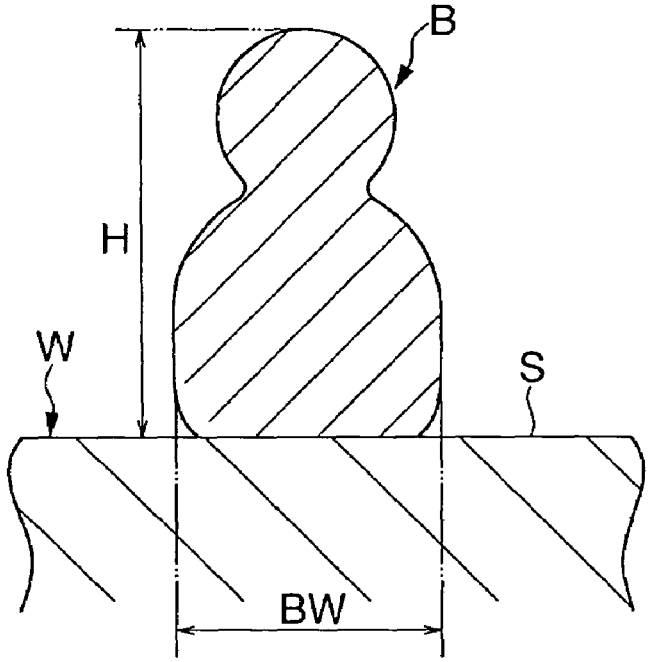
Figure 13:
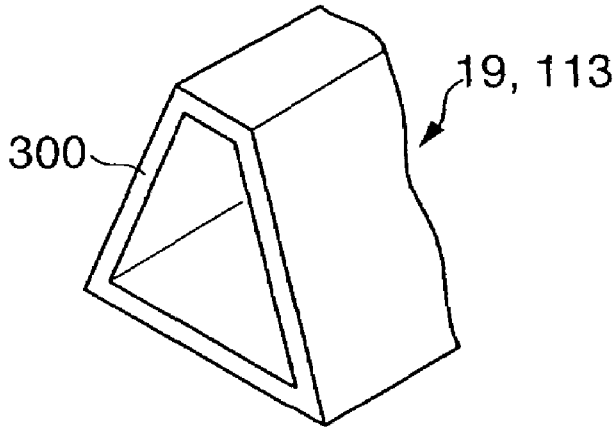
FIG. 13(A) is an enlarged perspective view of the front-end side of a nozzle according to another modification of the embodiment.
FIG. 13(B) is a vertical sectional view of a bead, which is formed when the nozzle in FIG. 13(A) is adopted.
Figure 13:
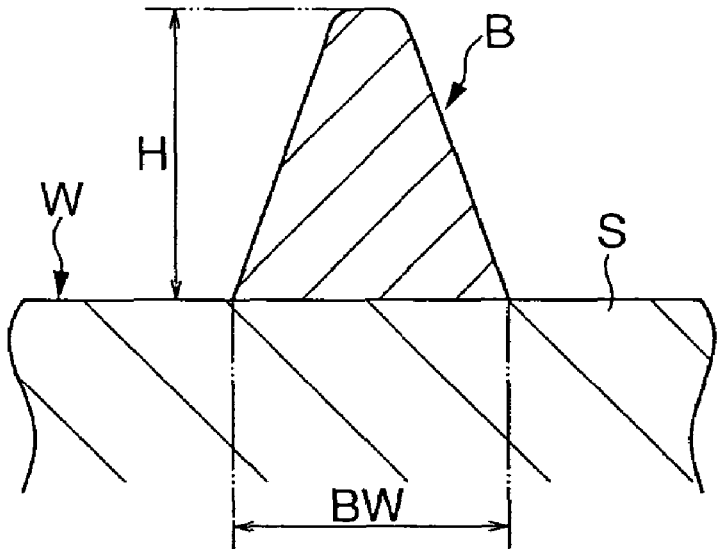

Also, the configuration of the discharge port 21, 124 of the nozzle according to the invention is not limited to the embodiments. Only when a non-circular configuration capable of forming a bead B having a sectional configuration, in which the height H is larger than 0.9 compared to the width BW of 1, is formed, configuration of a variety of profiles may be adopted. For example, as shown in FIG. 12, a discharge port 200 having an 8-shaped configuration capable of forming a bead B having an 8-shaped sectional configuration, and, as shown in FIG. 13, a discharge port 300 having a trapezoid configuration capable of forming a bead B having a trapezoid sectional configuration, are exemplified.

As described above, according to the invention, the discharge port of the nozzle-is formed into a non-circular configuration, and it is adapted so as to discharge the material so that a bead having a sectional configuration in which the height H is larger than 0.9 compared to the width W of 1 can be formed. Therefore, it is made possible to make the flow direction of the material within the nozzle and the discharge direction substantially coincide with each other; the material can be discharged onto the surface while generally maintaining the configuration of the discharge port; and as a result, a bead that allows a desirable deformation with a low pressure force can be obtained reliably.

Also, since such constitution that the nozzle is rotated is adopted, any problem does not arise from the capacity or size of the syringe. Accordingly, it is possible to rotate the nozzle at a high speed. Further, owing to that a high-speed rotation is possible, it is possible to increase the application speed resulting in increased application efficiency. Additionally, even when the nozzle is rotated, it is possible to maintain the rotational axis thereof at the fixed position. Accordingly, it is made possible to apply the material discharged from the discharge port along a predetermined track without allowing any positional displacement. Furthermore, since it is possible to reduce the moment of inertia accompanying the rotation of the nozzle, it is possible to miniaturize the motor resulting in a cost efficiency and a reduction of weight in the application means unit.

Still further, since the discharge port is formed into such profile that the first edge portion, which is positioned at the front side in the direction of movement over the track, becomes wider than the second end, which is positioned at the rear end side, in the width in the direction crossing the track, it is possible to reliably form a bead that has such sectional configuration that the upper end is smaller than the lower end in the width thereof.

Still furthermore, since the rotation of the nozzle is controlled so that the first end portion precedes the second end portion generally throughout the track, it is possible to handle such track that has curve portions like closed loop track or the like without any trouble.

INDUSTRIAL APPLICABILITY

The invention is applicable generally to apparatus that apply a sealing material to a surface where a various kinds of member is combined therewith.

The invention claimed is:

1. A material application apparatus comprising an application means for applying a material to a surface of a workpiece disposed on a base, and a movement means that makes said application means perform relative displacement along a predetermined movement track on said surface so as to apply the material into a bead configuration, wherein:

said application means includes a syringe and a nozzle being connected to the syringe and having a discharge port formed into a non-circular configuration; wherein the discharge port of said nozzle is parallel to the surface and is formed into an acute-angled triangle configuration having a base edge portion and a pair of side edge portions constituting two equilaterals longer than the base edge portion, and said nozzle is rotatable in the periphery direction thereof in a state that said syringe is not rotated in the peripheral direction thereof.

* * * * *